United States Patent [19]

Meyer et al.

[11] 3,990,704

[45] Nov. 9, 1976

[54] TARGET IMAGE PROJECTOR WITH SIMULATED GUN ASSEMBLY

[75] Inventors: Burton C. Meyer, Downers Grove; Fritz Fauser, Chicago, both of Ill.

[73] Assignee: Marvin Glass & Associates, Chicago, Ill.

[22] Filed: Dec. 29, 1975

[21] Appl. No.: 644,467

Related U.S. Application Data

[63] Continuation of Ser. No. 525,460, Nov. 20, 1974, abandoned.

[52] U.S. Cl. ..... 273/101.2; 273/105.1; 35/25

[51] Int. Cl.[2] ..... F41G 3/26

[58] Field of Search ..... 35/25; 273/101.1, 101.2, 273/102.2 R, 101, 105.1

[56] References Cited

UNITED STATES PATENTS

| | | | |
|---|---|---|---|
| 2,406,574 | 8/1946 | Waller | 273/105.1 |
| 2,467,180 | 4/1949 | Anderson | 273/101.2 |
| 2,470,592 | 5/1949 | Waller | 273/101.2 |
| 2,484,912 | 10/1949 | Shenker | 273/101.2 |
| 2,527,326 | 10/1950 | New | 273/101.2 |
| 2,680,620 | 6/1954 | Dale | 273/101.2 |
| 3,748,751 | 7/1973 | Breglia | 35/25 |
| 3,802,099 | 4/1974 | Mell | 35/25 |
| 3,811,204 | 5/1974 | Marshall | 35/25 |

*Primary Examiner*—Richard C. Pinkham
*Assistant Examiner*—Marvin Siskind
*Attorney, Agent, or Firm*—Coffee & Sweeney

[57] ABSTRACT

A target game of the type wherein a target image is movingly projected upon a screen for simulated shooting by a gun assembly. The target game generally includes a target projecting assembly for randomly exhibiting a moving target onto the screen and for giving an indication of a successful hit. A gun assembly is movably mounted over the target projecting assembly for selectively exhibiting a hit area on the screen and for causing the target projecting assembly to indicate a hit, along with a drive assembly. The target projecting assembly includes a first projector having a film holder which is movable between a "normal" position wherein a target image is presented for projection and a "hit" position wherein an explosion image is presented for projection. The target projecting assembly also includes a hit actuating member associated with the film holder to move the holder from its normal position to its hit position. The gun assembly includes a second projector for projecting a hit area on the screen and a trigger assembly a portion of which is adapted to engage the hit actuating member when said hit actuating member and trigger portion are aligned and the trigger assembly is depressed. If this occurs, the hit actuating member moves the film strip holder from its normal position to its hit position.

24 Claims, 11 Drawing Figures

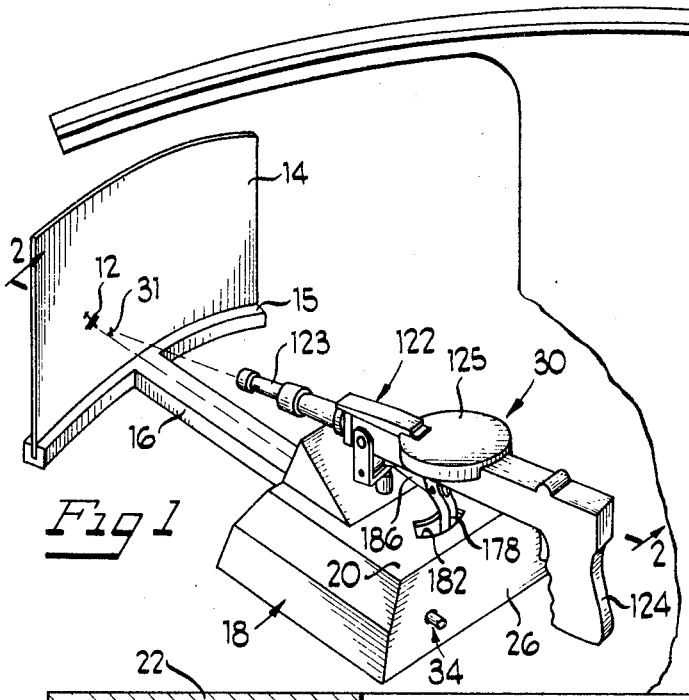
Fig 1
Fig 4
Fig 5
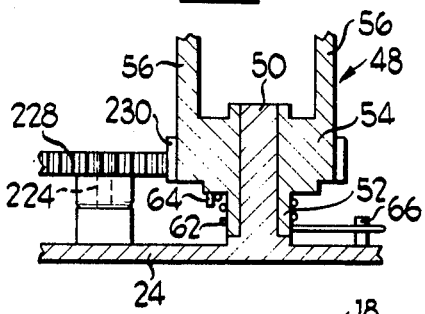
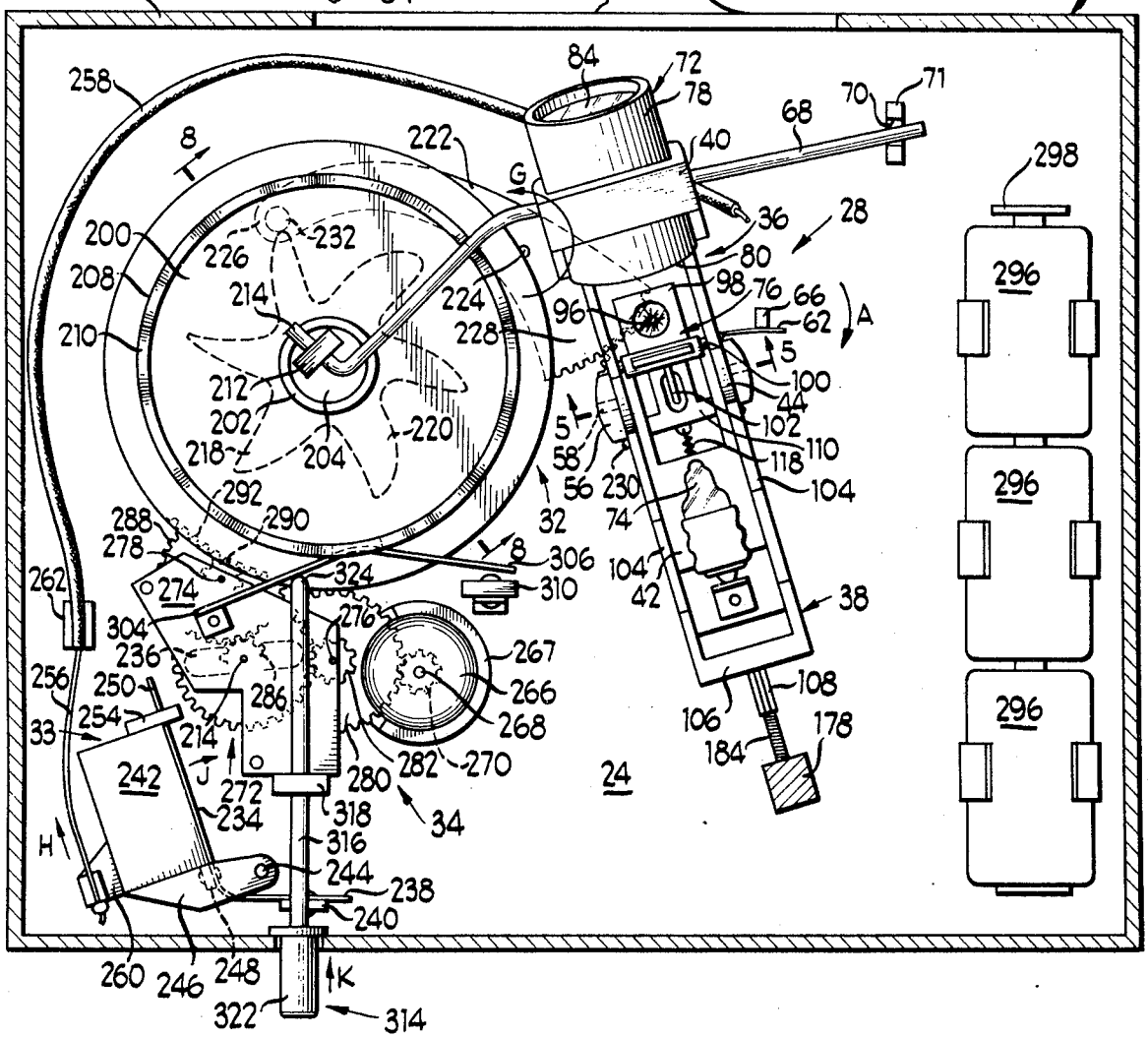

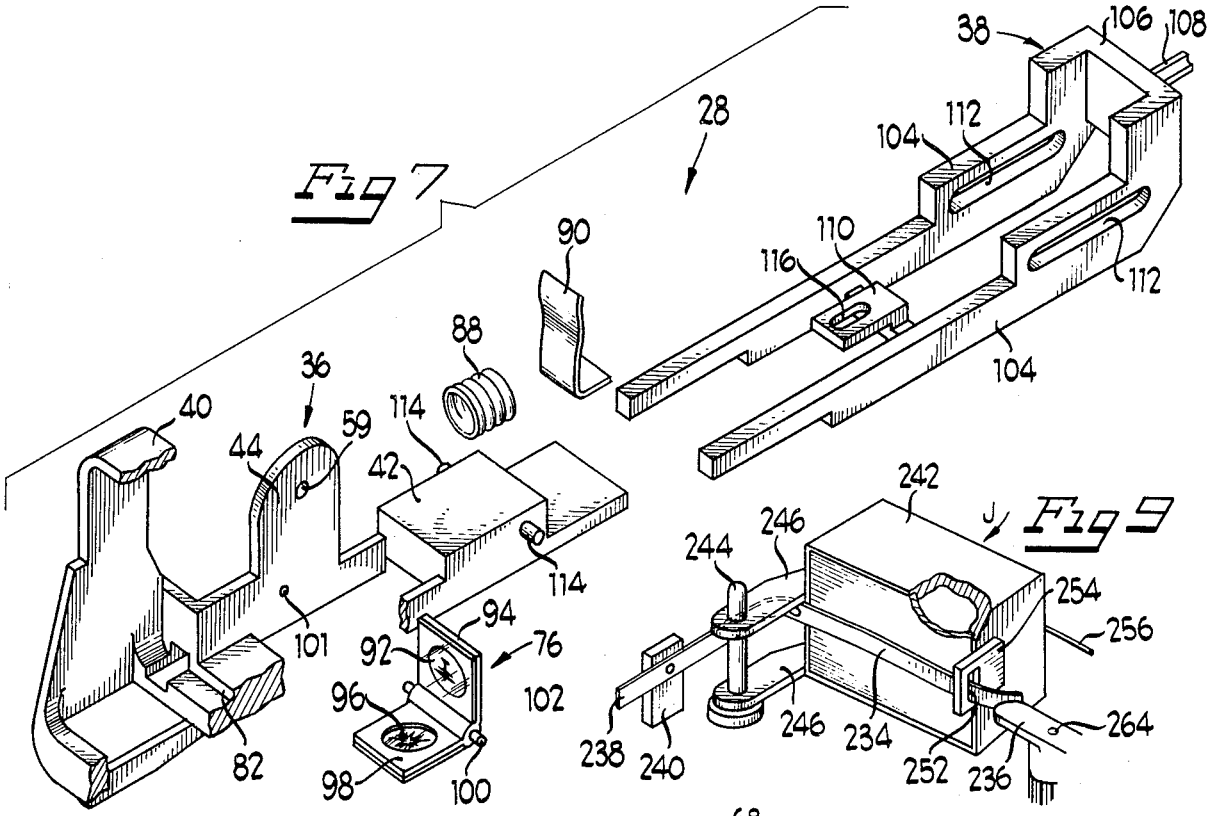
Fig 7
28
38
106
108
104
112
110
116
112
104
90
88
36
40
59
114
44
42
114
101
94
92
76
96
102
82
98
100
Fig 9
242
244
246
254
256
238
240
246
234
252
236
264
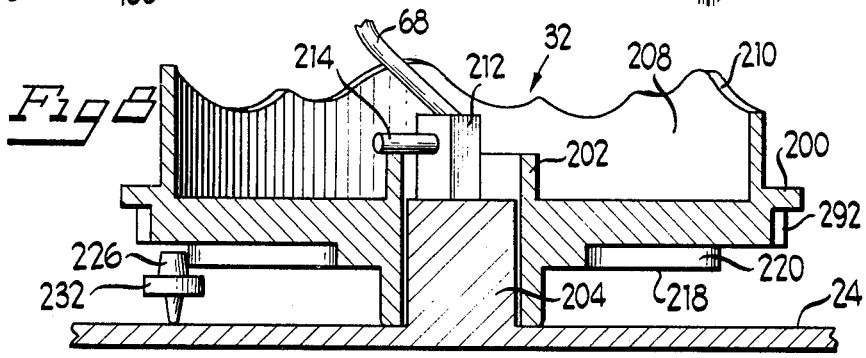
Fig 8
68
214
212
32
208
210
202
200
292
226
220
232
204
218
24
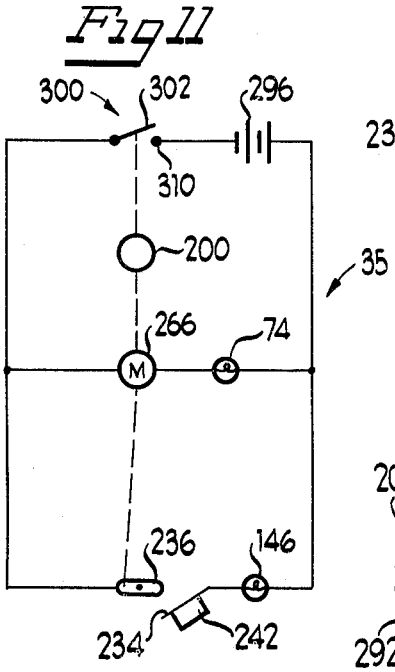
Fig 11
300
302
296
310
200
35
266
74
M
236
146
234
242
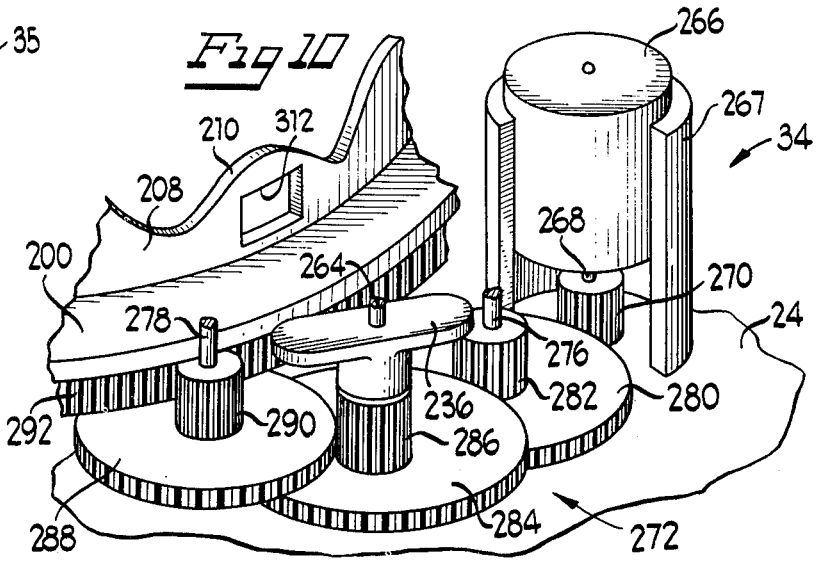
Fig 10
266
267
34
210
312
208
268
200
264
270
24
278
276
236
282
280
292
290
286
288
284
272

TARGET IMAGE PROJECTOR WITH SIMULATED GUN ASSEMBLY

CROSS REFERENCE TO OTHER APPLICATIONS

This is a continuation of application Ser. No. 525,460, filed Nov. 20, 1974, and now abandoned.

BACKGROUND OF THE INVENTION

1. FIELD OF THE INVENTION

The present invention generally relates to a simulated aerial projectile target game employing projectors.

2. BRIEF DESCRIPTION OF THE PRIOR ART

One example of a target game of the type contemplated is disclosed in U.S. Pat. No. 2,347,657 issued to M. J. Binks on May 2, 1944. The Binks patent discloses a randomly movable target projecting assembly which projects a target image onto a suitable surface such as a screen. A gun assembly is movably mounted over the target projecting assembly and has a striking finger which is adapted to engage an electrical contact which moves with the target projecting assembly. If the trigger is depressed and the electrical contact and striking finger are in alignment, the circuit is closed. When this occurs, another projector projects a red flash simulating an explosion onto the screen.

The drawbacks of prior target games are twofold. First, two projectors are required to exhibit a target and a successful hit, respectively. Second, an electrical circuit is required to actuate the mechanism. Both of these drawbacks make it a more complicated and expensive game to manufacture and service.

SUMMARY OF THE INVENTION

It is therefore an object of the present invention to provide a new and improved target game of the character described which is simpler and less expensive to manufacture.

One form of the invention as currently contemplated provides for a target projecting assembly and an adjacent movably mounted gun assembly. A drive assembly is provided to move the target projecting assembly in an irregular fashion.

The target projecting assembly includes a target projector for projecting a target or an explosion onto a screen or the like. Mounted in the target projector is a film strip holder having the image of a target as well as of an explosion. The film strip holder is movable in the target projector between a "normal" position wherein the target image is presented for projection and a "hit" position wherein the explosion image is presented for projection. A hit actuating member is movably mounted on the target projector and is associated with the film strip holder for moving the holder from its "normal" position to its "hit" position.

The gun assembly includes a gun projector for projecting a hit area onto the screen and a trigger assembly which, when actuated, causes the gun projector to exhibit the hit area. The trigger assembly includes a striking portion which is movable with the gun assembly relative to the hit actuating member of the target projector. The striking portion is adapted to engage the hit actuating member and move it whenever the trigger assembly is depressed and the striking portion and the hit actuating member are aligned. When this occurs, the film strip holder is moved from its normal position to its hit position.

BRIEF DESCRIPTION OF THE DRAWINGS

FIG. 1 is a perspective view of the target game of the present invention;

FIG. 4 is a sectional view taken generally along the line 4—4 of FIG. 2;

FIG. 5 is a sectional view taken generally along the line 5—5 of FIG. 4;

FIG. 6 is a side elevational view of a portion of the target projecting assembly shown partially in section;

FIG. 7 is an exploded perspective view of a portion of the target projecting assembly;

FIG. 9 is an enlarged fragmentary perspective view of a portion of the noise means of the present invention;

FIG. 10 is an enlarged fragmentary perspective view showing the drive assembly of the present invention; and FIG. 11 is a schematic electrical diagram showing the control assembly of the present invention.

DESCRIPTION OF THE PREFERRED EMBODIMENT

Figures 2, 3, 8:
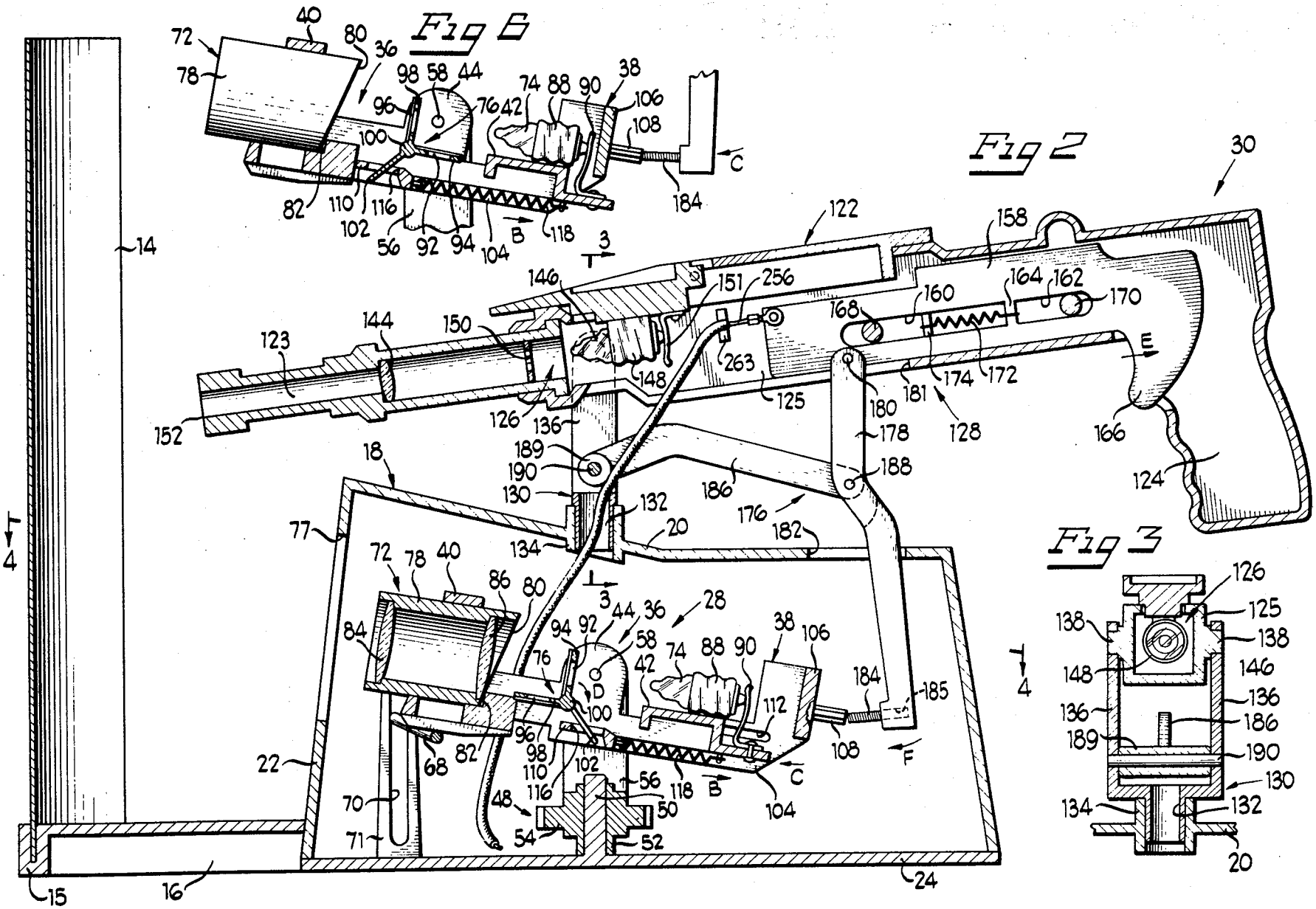
FIG. 2 is a sectional view, on an enlarged scale, taken generally along the line 2—2 of FIG. 1.
FIG. 3 is a sectional view taken generally along the line 3—3 of FIG. 2.
FIG. 8 is a sectional view taken generally along the line 8—8 of FIG. 4.

Turning to FIG. 1, the target game of the present invention generally comprises a moving projected target 12 in the form of an airplane which is projected on a curved screen 14 or other appropriate surface. The screen 14 is mounted on a base 15 at one end of a spacer member 16.

A housing, generally designated 18, is mounted at the other end of the spacer member 16. Looking at FIGS. 1, 2 and 4, the housing 18 is seen to include a top wall 20, a front wall 22, a floor wall 24, and a rear wall 26.

A target projecting assembly, generally designated 28, is received and mounted within the housing 18 (FIGS. 2 and 4). The target projecting assembly 28 exhibits a moving target 12 onto the screen 14 and, in addition, can project an indication of a successful hit.

A gun assembly, generally designated 30 (FIGS. 1 and 2), is movably mounted on the top wall 20 of housing 18 over the target projecting assembly 28. The gun assembly 30 selectively exhibits a hit area shown as an "X" 31 in FIG. 1 onto the screen 14.

A random guide assembly, generally designated 32 (FIGS. 4 and 8), also is received within the housing 18 and is operatively connected to the target projecting assembly 28 for randomly guiding the projected target 12 onto screen 14. A noise assembly, generally designated 33 (FIGS. 4 and 9), is operatively connected to the gun assembly 30 and simulates the sound of a machine gun in response to the actuation thereof. A drive assembly, generally designated 34 (FIGS. 4 and 10), is operatively connected to the random guide assembly 32 and the noise assembly 33 for moving the target projecting assembly 28 and for driving the noise assembly 33, respectively.

A control assembly, generally designated 35 (FIG. 11), energizes the drive assembly 34 and actuates the target game for a given period of time. The duration of this period of time denotes a "turn" that a player takes. The object of the game is to effect the largest number of successful hits of the projected target 12 by aiming the gun assembly 30 thereat.

I. THE TARGET PROJECTING ASSEMBLY

Turning now to FIGS. 2, 4, 5, 6 and 7, the target projecting assembly 28 will be discussed in greater detail. Looking at these figures, the target projecting assembly 28 is seen generally to comprise a target projector, generally designated 36, and a hit actuating member, generally designated 38, associated therewith. The target projector 36 projects the target image 12 or an image of an explosion (not shown) onto the screen 14. The hit actuating member 38 is movably mounted on the target projector 36 and causes the target projector to exhibit the explosion image when it moved.

A. THE TARGET PROJECTOR

As best shown in FIG. 7, the target projector 36 is seen to include a front lens mounting portion 40, a rear light mounting portion 42 and an intermediate slide mounting portion 44.

The target projector 36 is mounted on a turret, generally designated 48, which is rotatably journalled on an upstanding post 50 formed on the floor 24 of the housing 18 (FIGS. 2 and 5). The turret 48 has a lower neck portion 52, a middle portion 54 and two upper parallel spaced apart ears 56 extending upwardly from the middle portion 54. The target projector 36 is mounted on the turret between the ears 56 at the slide mounting portion 44 as best shown in FIGS. 3 and 6. The connection between the turret 48 and target projector 36 is effected by two inwardly protruding pins 58 formed on the ears 56 which are received through openings 59 in the slide mounting portion (FIG. 7) to pivotally mount the target projector 36 between ears 56. In this configuration, the target projector is able to rotate about a vertical axis as defined by the upstanding post 50 and simultaneously about a horizontal axis as defined by pins 58, providing a universal moving means.

Turret 48 is provided with a coil spring 62 wrapped around the neck portion 52 thereof (FIGS. 4 and 5). The upper part of spring 62 bears against a depending stub 64 while the lower end of spring 62 bears against an upstanding stub 66 formed on the floor 24. In this manner, the turret 48 and the mounted target projector 36 is biased in the direction indicated by arrow A in FIG. 4.

A bent rod 68 supports the front of the target projector 36 below the lens mounting portion 40. The free end of the rod 68 is received in a vertical slot 70 formed in a guide member 71 as best shown in FIGS. 2 and 4. Thus, if rod 68 moves up and down within slot 70, the target projector 36 is moved up and down by rotation about pins 58.

The target projector 36 includes an optical assembly, generally designated 72 (FIGS. 2, 4 and 6), mounted in the lens mounting portion 40, a lightbulb 74 (FIGS. 2, 4 and 6) mounted in the light mounting portion 42, and an L-shaped film strip holder, generally designated 76 (FIGS. 2, 4, 6 and 7), mounted in the slide mounting portion 44. When actuated, the image formed by the interaction of the lightbulb 74, the film strip holder 76 and the optical assembly 72, projects an image through an opening 77 formed in the front wall 22 of housing 18 onto the screen 14 (FIGS. 2 and 4).

Looking at FIGS. 2, 4 and 6, the optical assembly 72 is seen generally to comprise a generally cylindrical lens barrel 78 having a slanted rear surface 80 which is adapted to be received in a ridge or shoulder 82 formed at the bottom of the lens mounting portion. Mounted within the barrel 78 is a front lens 84 and a rear lens 86 which, in combination, optically are employed to form an image on screen 14. By rotating the lens barrel 78, the focal length of the target projector 36 can be changed because the entire barrel moves backward or forward with respect to the lightbulb 74 due to the engagement of the slanted rear surface 80 with shoulder 82.

The lightbulb 74 is received in a lightbulb socket 88 which is mounted on top of the light mounting portion 42. The rear of the socket 88 is in engagement with an electrical contact 90 which is electrically connected to a suitable electrical power source.

The film strip holder 96 contains a bent around film slide having a film slide portion 92 with an image of an airplane mounted in one leg 94 of the holder and a second film slide portion 96 with an image of an explosion mounted in the other leg 98 of the holder (see FIGS. 2, 4, 6 and 7). Although an image of an explosion is shown, any other type of image for indicating a hit is contemplated. The film strip holder 96 has a horizontal shaft 100 at the juncture of the legs 94 and 98 the ends of which are journalled in openings 101 of the slide mounting portion 44. A generally downwardly extending leg 102 depends from the horizontal shaft 100 as best shown in FIGS. 2, 6 and 7. By moving the leg 102 either forward or backward, the film strip holder 76 is made to rotate about horizontal shaft 100.

B. THE HIT ACTUATING MEMBER

Looking at FIG. 7, the hit actuating member 38 includes two parallel spaced apart legs 104 joined at their rear by a bight portion 106. A protrusion 108 extends rearwardly from the bight portion 106. A film strip holder capturing portion 110 is mounted between the legs 106 for reasons which will become more apparent hereinafter.

Each leg 104 has a horizontally extending guide slot 112 formed therein. Each guide slot 112 receives a pin 114 extending from either side of the slide mounting portion 44. In this manner, the hit actuating member 38 is mounted for horizontal reciprocal movement with respect to the target projector 36.

The capturing portion 110 has a hole 116 formed therein for receiving the slide holder depending leg 102 therethrough. Thus, when the hit actuating member 38 is caused to slide, the film strip holder 76 is caused to rotate about horizontal shaft 100.

As best shown in FIGS. 2 and 6, a spring 118 is secured between the capturing portion 110 of the hit actuating member 38 and the bottom of the light mounting portion 42. This biases the hit actuating member 38 in the direction indicated by arrow B in FIGS. 2 and 6.

FIG. 2 shows the target projecting assembly 28 and its film strip holder 76 in its normal position. When in the normal position, film strip holder leg 94 is in a vertical disposition while film strip holder leg 98 is horizontal. Thus, the film strip 92 depicting the airplane is presented for projection onto screen 14.

FIG. 6 shows the target projecting assembly 28 and the film strip holder 76 in its hit position. When in the hit position, slide holder leg 98 is in a vertical disposition while slide holder leg 94 is in a horizontal disposition. Thus the film strip 96 of the explosion is presented for projection onto the screen 14.

The target projecting assembly 28 and the film strip holder 76 are moved from its normal position to its hit position by moving the hit actuating member 38 in the direction of arrow C as shown in FIGS. 2 and 6. When the hit actuating member 38 is moved in the direction indicated by arrow C, the capturing portion 116 pushes the leg 102 of the film strip holder 76. This causes the film strip holder to rotate about horizontal shaft 100 in the direction indicated by arrow D in FIG. 2. If no forces are present, the film strip holder 76 rotates from its hit position back to its normal position due to the force exerted by spring 118.

II. THE GUN ASSEMBLY

Turning now to FIGS. 1 and 2, the gun assembly 30 will be discussed in greater detail. The gun assembly 30 generally comprises a hollow housing 122 simulating a gun. The gun housing 122 has a front barrel portion 123, a rear handle portion 124 and an intermediate portion 125.

The gun housing 122 receives a gun projector, generally designated 126 in the barrel 123, and a trigger assembly, generally designated 128. The gun assembly 30 is movably mounted over the target assembly 28 and the housing 18 and selectively exhibits a hit area 31 onto screen 14 and actuates the hit actuating member 38.

The gun housing 122 is mounted on a turret, generally designated 130, as best shown in FIGS. 2 and 3. The turret 130 has a hollow opening at the top and a bottom post portion 132 rotatably received in an open cylinder 134 formed in the top wall 20 of housing 18. A pair of spaced apart parallel ears 136 extend upwardly from the bottom portion 132 to receive the gun housing 122 therebetween.

The gun housing 122 has two pins 138 (FIG. 3) extending laterally from the sides thereof to be received in openings (not numbered) formed at the top of each ear 136. By this configuration, the gun assembly 30 can rotate about a vertical axis defined by the bottom post portion 132 of turret 130 and also about the horizontal axis defined by pins 138, providing universal movement.

A. THE GUN PROJECTOR

As best seen in FIG. 2, the gun projector 126 includes a forwardly mounted lens 144, a rearwardly mounted lightbulb 146 received in a socket 148 and an intermediately mounted film strip holder 150 containing a film strip (not shown) representative of a hit area. The lightbulb socket 148 is operatively connected to an electrical contact 151 which is in turn electrically connected to a suitable electrical power source. Whenever the lightbulb 146 is illuminated, the image of the hit area is projected through the barrel opening 152 of the gun housing 122 onto screen 14.

B. THE TRIGGER ASSEMBLY

As best seen in FIG. 2, the trigger assembly includes a trigger plate 158 movably mounted within the intermediate portion 125 of the gun housing 122. The trigger plate 158 has two guide slots 160 and 162 separated by a column 164. A finger engaging portion 166 extends somewhat out of the handle portion 124 of the gun housing 122.

The intermediate portion 125 of gun housing 122 has two horizontal posts 168 and 170 formed in the interior thereof which are received and captured within slots 160 and 162, respectively. The trigger plate 158 is biased in the direction opposite that of arrow E of FIG. 2 by means of a spring connected between the column 164 and a stub 174 formed in the interior of the gun housing 122.

A linkage, generally designated 176 (FIG. 2), is associated between the trigger plate 158 and the hit actuating member 38. The linkage 176 includes a vertical member 178 pivotally pinned on the trigger plate at 180 and extending downwardly through an opening 181 in the bottom of the intermediate portion 125 of the gun housing 122 and through a curved slot 182 formed in the top wall 20 of housing 18. The bottom of the vertical member 178 thus is received within housing 18 and has a forwardly extending horizontal protrusion 184 in the form of a coil spring received at one end of an aperture 185. As can be best seen in FIG. 1, when the gun housing 122 is rotated about the vertical axis of the turret 130, the vertical member 178 of the parallel linkage 176 moves within curved slot 182.

The linkage 176 also includes a horizontal member 186 pivotally pinned to the vertical member 178 between the gun housing 122 and the target housing 18 at 188. The other end 189 of the horizontal member is rotatably mounted on a shaft 190 that extends between the two ears 136 of turret 130.

The trigger assembly 128 is actuated by depressing the finger engaging portion 166 in the direction indicated by arrow E in FIG. 2. This causes the trigger plate 158 to move linearly in the direction indicated by arrow E. The movement of the trigger plate 158 causes the vertical member 178 to pivot about point 188 so that the protrusion 184 at the bottom of the vertical member is moved in the direction indicated by arrow F in FIG. 2. Because of the particular configuration of the linkage 176, the actuation of the trigger assembly 128 always can be effected no matter what disposition the gun assembly 30 may assume. When the pressure from pressing finger engaging portion 166 is released, spring 172 returns the trigger assembly 128 back to its initial position.

Should the forwardly extending protrusion 184 of the vertical member 178 be in general alignment with the rearwardly extending protrusion 108 of the hit actuating member 38 as shown in FIG. 2, actuation of the trigger assembly 128 causes the target projecting assembly 28 to move from its normal position to its hit position as shown in FIG. 6. Specifically, this is caused by the spring protrusion 184 of the vertical member 178 pushing the actuating member 38 at its protrusion 108, due to the longitudinal rigidity of the coil spring, in a direction opposite that indicated by arrow B in FIG. 2. As already discussed, this causes the film strip holder 76 to rotate about its shaft 100 in the direction indicated by arrow D in FIG. 2.

III. THE RANDOM GUIDE ASSEMBLY

In order to make it more difficult to align protrusions 108 and 184 to effect a successful hit, the random guide assembly 32 is provided. A portion of the random guide assembly guides the target projector 36 in a vertical direction and another portion guides the target projector in a horizontal direction. Both originate with a circular disc member 200 (FIGS. 4 and 8) each of which has a central hub 202 which is open at the top and which is rotatably mounted on an upstanding post 204 formed on the floor 24 of housing 18.

An upstanding ridge 208 is formed generally around the periphery of the disc member 200. The top surface 210 of ridge 208 defines an irregular cam surface.

A rod mounting block 212 is secured to the top of the upstanding post 204 to pivotally receive the end 214 of the bent rod 68 (FIGS. 4 and 8). Because the free end of rod 68 is captured within slots 70 of the vertical guide member 71, rotation of the disc member 200 will cause the rod 68 which rests on the cam surface 210 to ride up and down in accordance with the contour of ridge 208. As the rod 68 goes up and down the front of the target projector 36 also moves up and down therewith. This is due to the fact that the front of the target projector 36 relies on the rod 68 for its support. Thus, the changing disposition of rod 68 will cause the entire target projector to pivot about pins 58 of the turret 48.

The side-to-side or rotational movement of the target projector 36 in the horizontal plane is governed by a generally star-shaped member 218 formed on the bottom of the circular disc member 200 (FIGS. 4 and 8). The star-shaped member 218 has an outwardly radially facing cam surface 220.

A connecting member 222 is operatively associated between the star-shaped member 218 and the turret 48 of the target projector 36. The connecting member 222 is pivoted on the floor 24 of housing 18 about a vertical shaft 224 (FIGS. 4 and 5). A follower portion 226 is formed at one end of the connecting member 222 and a gear rack portion 228 is formed at the other end of the connecting member. The gear rack portion 228 of the connecting member 222 is in meshing engagement with a gear 230 formed on the middle portion 54 of the target assembly turret 48 (FIGS. 4 and 5).

The follower portion 226 of connecting member 222 has a depending spacer 232 formed thereon as best shown in FIG. 8. The spacer serves to maintain the follower portion 226 at the same height as the cam surface 220 of the star-shaped member 218 so that engagement can be effected therebetween.

Because the target projecting assembly 28 is biased by spring 62 in the direction indicated by arrow A in FIG. 4, the connecting member 222 is rotatably biased about shaft 224 in the direction indicated by arrow G of FIG. 2. Thus, the follower portion 226 of the connecting member 222 always is urged toward the middle of the circular disc member 200.

If the disc member 200 rotates, the follower portion 226 will be forced radially outwardly due to the cam surface 220 of the star-shaped member 218. This causes the connecting member 222 to rotate about shaft 224 in a direction opposite that shown by arrow G in FIG. 2. This in turn causes the target projecting assembly 28 to rotate in a direction opposite that of arrow A shown in FIG. 2.

As can be seen in FIGS. 4 and 8, the movement of the target projecting assembly 28 in both the horizontal and vertical planes occurs simultaneously. Thus, the image 12 projected onto screen 14 moves around in an irregular fashion thereover. Because the entire target projecting assembly 28 is guided in this fashion, the rearwardly extending protrusion 108 of the actuating member 38 likewise moves in a similar irregular path. A player thus aims the gun assembly 30 at the projected image 12 and actuates the trigger assembly 128 in an attempt to have protrusion 184 engage the irregularly moving protrusion 108.

IV. THE NOISE ASSEMBLY

As shown in FIGS. 4, 9 and 10, the noise assembly 33 generally includes a bent leaf spring 234 which is selectively engageable with a rotating sprocket wheel 236. The sound produced by the engagement simulates a machine gun sound.

One end 238 of leaf spring 234 is secured to an upstanding stub 240 formed on the floor 24 of housing 18. The leaf spring then is bent from the stub 240 in association with a spring moving hollow sound box 242. The box 242 is rotatably mounted on a post 244 which is freely received between two spaced apart horizontal brackets 246 on one end of the box 242.

The leaf spring 234 is secured to a tab 248 between brackets 246 while the free end 250 is received through a slot 252 formed in another tab 254 attached to the other end of box 242. The free end 250 of leaf spring 234 extends outside of the tab 254 to engage the sprocket wheel 236.

A cable 256, covered by suitable generally rigid material 258, interconnects the trigger plate 158 (FIG. 2) with the box 242. The cable 256 is secured to the box on a suitable tab 260. The cover 258 is held between clamp 262 on floor 24 and clamp 263 on the interior of the gun housing 122 and extends through the hollow turret 132.

The leaf spring 234 normally is spaced from sprocket wheel 236 as shown in FIG. 4. When the trigger assembly 128 is actuated, cable 256 is pulled in the direction indicated by arrow H of FIG. 4. This causes the box 242 to pivot about post 244 in the direction indicated by arrow J in FIGS. 4 and 9 thereby b bringing the free end 250 of leaf spring 234 into engagement with the sprocket wheel 236 as shown in FIG. 9 so as to strike the box. When the finger engaging portion 166 of the trigger plate 158 is released, spring 172 returns the cable 256 and box 242 back to its initial position.

The sprocket wheel 236 is mounted for relative rotation on a sprocket shaft 264. Thus, when the free end 250 of leaf spring 234 is brought into engagement with the sprocket wheel and the sprocket wheel is rotating, an intermittent noise simulating a machine gun is produced. This noise occurs whenever the trigger assembly 128 is actuated.

V. THE DRIVE ASSEMBLY

Turning now to FIGS. 4 and 10, the drive assembly 34 will be discussed in greater detail. The drive assembly 34 generally includes an electric motor 266 mounted in a motor housing 267 formed in the shape of a partial hollow cylinder. The motor 266 has a downwardly extending drive shaft 268 having a pinion gear 270 fixedly secured thereto. The motor pinion gear 270 is associated with a gear train, generally designated 272, which is mounted between the floor 24 of housing 18 and a spaced horizontal gear plate 274 (FIG. 4). The gear train 272 includes a sprocket shaft 264 along with two other vertical shafts 276 and 278, respectively. These shafts are all fixed between the floor 24 and the gear plate 274.

Shaft 276 rotatably mounts gear 280 and pinion gear 282 which are fixedly secured to each other. Sprocket shaft 264 is rotatably mounted with respect to gear 284, pinion gear 286, and the sprocket wheel 236. Gear 284, pinion gear 286 and sprocket wheel 236 are all fixedly secured to one another. Shaft 278 is rotatably mounted with respect to gear 288 and pinion gear 290 which are fixedly secured to each other.

As best can be seen in FIG. 10, motor pinion 270 is in meshing engagement with gear 280; pinion gear 282 is in meshing engagement with gear 284; pinion gear 286 is in meshing engagement with gear 288; and pinion gear 290 is in meshing engagement with a gear surface 292 formed along the lateral periphery of the circular disc member 200. Thus, when the motor 266 is actuated, power is transmitted from the motor drive shaft 268 through gear train 272 to rotate both the sprocket wheel 236 and the circular disc member 200. In effect, the drive assembly 34 drives a portion of the noise assembly 33 and the guide assembly 32.

VI. THE CONTROL ASSEMBLY

The control assembly 35 energizes the drive assembly 34, illuminates the lightbulb 74 in the target projector 36, illuminates the lightbulb 146 in the gun projector 126 when the trigger assembly 128 is actuated, and turns the game on and off. To this end, there is provided a plurality of batteries 296 mounted in a suitable battery carriage 298 (FIG. 4).

The circuit comprising the control assembly 35 is shown in greater detail in FIG. 11. Switch means, generally designated 300 is in series with the batteries 296 and serves to begin the game and automatically end the game. The switch means 300 and batteries 296 are connected to the target projector lightbulb 74 and the motor 266. Thus when the switch means 300 is in a closed position, the target projector 36 will be projecting the image 12 on the screen 14 while the drive assembly 34 and guide assembly 32 move the target projector 36 in an irregular fashion.

The batteries 296 and switch means 300 also are connected to the gun lightbulb 146 to actuate the bulb only when the trigger assembly 128 is actuated. To this end, there is provided a second switch means comprising the leaf spring 234 and the sprocket wheel 236 as contacts thereof. More specifically, the target lightbulb is electrically connected to the batteried 296 at one end thereof and is electrically connected to the leaf spring 234 at the other end thereof. The sprocket wheel 36, sprocket shaft 264 and gear plate 274 all are made of electrically conductive material. Thus, looking at FIG. 4, it can be seen that the sprocket wheel 236 is electrically connected to the switch means 300. Accordingly, when leaf spring 234 is brought into engagement with the sprocket wheel 236 by actuation of the trigger assembly 128, an electrical circuit is completed resulting in the illumination of target lightbulb 146. However, because sprocket wheel 236 intermittently strikes leaf spring 234, the target lightbulb 146 will be illuminated intermittently corresponding to the machine gun noise that is produced.

Turning now to FIG. 4 in greater detail, the switch means 300 is seen generally to include a bent movable contact, generally designated 302, having a fixed end 304, a free end 306, and an intermediate bent portion 308. The fixed end 304 is secured to the top of the gear plate 274. The free end 306 of contact 302 is adapted to touch a fixed contact 310 secured to the floor 24 of housing 18. The movable contact 302 is flexible and is normally urged away from fixed contact 310. In fact, the free end 306 would be normally spaced from the fixed contact 310 were it not for the fact that the bent portion 308 bears against the upstanding ridge 208 of the circular disc member 200 which urges the free end 306 into touching relationship with the fixed contact 310.

It has been found desirable to have a given time period during which a player may operate the hit actuating assembly. Toward this end, the switch means 300 also serves as an interrupter switch. Specifically, an opening 312 is formed in the upstanding ridge 208 of the circular disc member 200 (see FIGS. 4 and 10). The bent portion 308 of the movable contact 302 is adapted to be received within opening 312. When bent portion 308 is thus received, the free end 306 is allowed to move away from the fixed contact 310 thereby opening the circuit and shutting off the game. As can be seen, the duration of one turn is the time that it takes for one revolution of the circular disc member 200.

To close the switch means 300 when the bent portion 308 is received within the opening 312, an actuator, generally designated 314 (FIG. 4), is provided. The actuator 314 generally includes a horizontal push rod 316 slidably received through a collar 319 and an opening (not numbered) in the rear wall 26 of housing 18. One end of the push rod 316 extends outside of housing 18 and has a pushbutton 322 formed thereon. The other end 324 of push rod 316 engages the movable contact 302.

When the switch means 300 is in its initial open position as shown in FIg. 4 and the push rod is pushed inwardly in the direction of arrow K, the free end 306 is pivoted into engagement with the fixed contact 310 thereby closing the circuit. When the circuit is initially closed, the circular disc member 200 commences rotating until the bent portion 308 moves out of the opening 312. At this point, the push rod can be released and the game will run for one revolution of the circular disc member 200.

VII. OPERATION OF THE GAME

The game of the present invention can be played by one or more players. The object of the game is to score as many "hits" as possible during one playing period.

To commence the game, a player pushes the push rod 316 in the direction of arrow K shown in FIG. 4. This energizes the drive assembly 34 which runs the random guide assembly 32. In addition, the control assembly 35 illuminates the target lightbulb 74 so that an image of an airplane 12 is movingly exhibited onto screen 14.

The player then grasps the gun housing 12 at its handle 124 and aims at the moving projected image 12. When the player thinks that he is on target, he squeezes the finger engaging portion 166 of the trigger plate 158 in order to actuate the trigger assembly 128. This causes the leaf spring 234 to be in an engaging position relative to the sprocket wheel 236. Every time leaf spring 234 engages sprocket wheel 236 a noise is produced along with a momentary closure of the circuit which includes the gun lightbulb 146. The resultant projected hit area 31 will be flashed intermittently on the screen 14 relative to the projected airplane 12. When the projected hit area 31 overlies the projected target 12, spring 184 of the trigger assembly 128 will be aligned with protrusion 108 of the hit actuating member 38. If, at this point, the trigger assembly 120 is actuated, the target projector 36 and its film strip holder 76 will move from its normal position to its hit position due to the longitudinal rigidity of the spring 184 against protrusion 108. The image of the airplane then will be changed to an image of an explosion signifying a successful hit. After a successful hit and upon release of the trigger or lateral movement of spring 184, spring 118 will return the hit actuating member to its initial position thereby causing the target projector 36 to return to its "normal" position.

The above procedure is repeated during a player's turn. At the end of his turn, the switch means 300 will automatically shut off the game. The player then counts up the number of successful hits he has accumulated during that turn. It should be noted that a player cannot simply hold the trigger down in attempting to score hits. If this is done, the spring 184 simply will abut against the sides of protrusion 108 and, due to the side resiliency of the spring, simply pass around protrusion 108, rather than pushing it in the direction of arrow C (FIG. 4).

The foregoing detailed description has been given for clearness of understanding only and no unnecessary limitations should be understood therefrom as some modifications will be obvious to those skilled in the art.

We claim:

1. A target game comprising:

a target projecting assembly including a target projector for projecting an image of either a target or a hit onto a screen or the like, said target projector having image means mounted thereon for movement between a normal position wherein the target image is presented for projection and a hit position wherein the hit image is presented for projection, and a hit actuating member movably mounted on the target projecting assembly and operatively associated with an image means for moving said image means from its normal target projecting position to its hit projecting position;

an aimable gun assembly movably mounted adjacent said target projecting assembly including a selectively actuatable trigger assembly including a striking portion movable with said gun assembly relative to said hit actuating member of the target projecting assembly and adapted to engage said hit actuating member and move said image means from its normal position to its hit position whenever said trigger assembly is actuated and said striking portion and said hit actuating member are aligned;

a guide assembly operatively connected to said target projecting assembly for movably guiding the projected image onto the screen and simultaneously and correspondingly moving said hit actuating member relative to the striking portion of said trigger assembly; and a drive assembly operatively connected to said guide assembly for moving said target projecting assembly.

2. The target game of claim 1 wherein said image means includes a film holder having a film slide of a target and a film slide of a hit alternately movable by said hit actuating member into projecting position.

3. The target game of claim 2 wherein said film strip holder is L-shaped having the film slide of the target mounted on one leg thereof and the film slide of the hit mounted on the other leg thereof, said film strip holder being pivotally mounted on said projecting assembly for pivotal movement of the film slides into projecting position.

4. The target game of claim 2 wherein said hit actuating member is linearly slidably mounted on said target projecting assembly engageable with said film strip holder so that when said hit actuating member is moved from an initial position, the film strip holder will be moved from its normal target projecting position to its hit projecting position.

5. The target game of claim 4 including biasing means associated with said hit actuating member to return said member back to its initial position after actuation thereof so that said film strip holder will return from its hit projecting position back to its normal target projecting position.

6. The target game of claim 4 wherein said hit actuating member generally is in the form of a longitudinal protrusion and said striking portion generally is in the form of a longitudinal protrusion linearly movable generally parallel to the hit actuating member so as to permit actuation only when the ends of the protrusions are aligned to thereby preclude a user from registering a hit by continuously actuating the hit assembly.

7. The target game of claim 6 wherein the longitudinal protrusion of the hit actuating member is in the form of a coil spring.

8. The target game of claim 1 wherein said gun assembly includes a gun projector for protecting a hit area onto the screen movable thereover corresponding to the gun assembly movement.

9. The target of claim 1 wherein said target projecting assembly is mounted for universal movement on a turret, said guide assembly including means to move said target projecting assembly simultaneously in a programmed horizontal plane and means to move said target projecting assembly in a programmed vertical plane to move said image over the screen in an irregular path.

10. The target game of claim 9 wherein said means for moving said target projecting assembly in a vertical plane includes a rotatable circular upstanding ridge having an irregular cam surface defined on the top surface thereof and a follower movable on said cam surface and supporting the target projecting assembly so that as the follower moves vertically the target projecting assembly correspondingly moves vertically.

11. The target game of claim 9 wherein said means to move said target projecting assembly in a horizontal plane includes movable cam means associated with said turret for rotating said turret about a vertical axes.

12. The target game of claim 1 including a noise assembly simulating the sound of a machine gun in response to actuation of the trigger assembly.

13. The target game of claim 12 wherein said noise assembly includes a rotatable sprocket wheel and a leaf spring normally spaced from said sprocket wheel and movable between a normal position spaced from said sprocket wheel and an engaged position wherein the leaf spring is engageable with said sprocket wheel, and means associated between the trigger assembly and the leaf spring for moving said leaf spring from its normal position to its engaged position whenever the trigger assembly is actuated.

14. A target game comprising:

a target projecting assembly including a target projector for projecting an image of a target onto a screen or the like, and including a hit actuating member on the target projecting assembly and movable relative to the target projecting assembly in at least one given direction for registering a hit indication;

a drive assembly operatively associated with said target projecting assembly for moving the target projecting assembly and thereby correspondingly moving the image projected thereby in a path over said screen; and an aimable gun assembly mounted adjacent the target projecting assembly and movable independently relative thereto, with a selectively actuatable trigger assembly including a striking portion movable with the gun assembly relative to the hit actuating member of the target projecting assembly and adapted to movably engage the hit actuating member to move the same in said direction to register a hit only when aligned therewith to preclude a user from registering a hit by continuous actuation of the trigger assembly.

15. The target game of claim 14 wherein said hit actuating member generally is in the form of a longitudinal protrusion mounted for linear movement in said given direction, sand said striking portion generally is in the form of a longitudinal protrusion mounted for axial movement generally parallel to the hit actuating member so as to permit actuation only when the ends of the protrusions are aligned, said protrusions being of sufficient length to cause lateral interference thereby precluding a user from registering a hit by continuously actuating the trigger assembly while moving the same to move said striking portion in a direction transverse to said protruding hit actuation member.

16. A target game, comprising: a target projecting assembly including a target projector for projecting an image of a target onto a screen or the like, and including a hit actuating member on the target projecting assembly for projecting a hit indication, said hit actuating member being generally in the form of a longitudinal protrusion; a drive assembly operatively associated with said target projecting assembly for moving the target projecting assembly and thereby correspondingly moving the image projected thereby in a path over said screen; and aimable gun assembly mounted adjacent the target projecting assembly and movable independently relative thereto, with a selectively actuatable trigger assembly including a striking portion movable with the gun assembly relative to the hit actuating member of the target projecting assembly, said striking portion being in the form of a generally longitudinal protrusion mounted for axial movement generally parallel to the protruding hit actuating member so as to permit actuation only when the ends of the protrusions are aligned, said protrusions being of sufficient length to cause lateral interference thereby precluding a user from registering a hit by continuously actuating the trigger assembly while moving the same to move said striking portion in a direction transverse to said protruding hit actuating member.

17. A target game comprising:

a target projecting assembly including a target projector for projecting an image of either a target or a hit onto a screen or the like, said target projector having image means mounted thereon for movement between a normal position wherein the target image is presented for projection and a hit position wherein the hit image is presented for projection, and hit actuating means mounted on the target projecting assembly and operatively associated with the image means for moving said image means from its normal target projecting position to its hit projecting position;

an aimable gun assembly movably mounted adjacent said target projecting assembly including a selectively actuatable trigger assembly including a portion movable with said gun assembly relative to said hit actuating means of the target projecting assembly and adapted to actuate said hit actuating means to move said image means from its normal position to its hit position whenever said trigger assembly is actuated and said gun assembly is properly aimed with said target image;

a guide assembly operatively connected to said target projecting assembly for movably guiding the projected image onto the screen; and a drive assembly drivingly connected to said guide assembly.

18. The target game of claim 17 wherein said image means includes a film holder having a film slide of a target and a film slide of a hit alternately movable by said hit actuating means into projecting position.

19. The target game of claim 18 wherein said film strip holder is L-shaped having the film slide of the target mounted on one leg thereof and the film slide of the hit mounted on the other leg thereof, said film strip holder being pivotally mounted on said projecting assembly for pivotal movement of the film slides into projecting position.

20. The target game of claim 19 including biasing means associated with said hit actuating means to return said means back to its initial position after actuation thereof so that said film strip holder will return from its hit projecting position back to its normal target projecting position.

21. The target game of claim 19 including biasing means associated with said image means for returning the image means back from its hit position to its normal target projecting position after being actuated by said hit actuating means.

22. The target game of claim 17 wherein said gun assembly includes a gun projector for projecting a hit area onto the screen movable thereover corresponding to the gun assembly movement.

23. The target game of claim 17 including a noise assembly simulating the sound of a machine gun in response to actuation of the trigger assembly.

24. The target game of claim 23 wherein said noise assembly includes a rotatable sprocket wheel and a leaf spring normally spaced from said sprocket wheel and movable between a normal position spaced from sprocket wheel and an engaged position wherein the leaf spring is engageable with said sprocket wheel, and means associated between the trigger assembly and the leaf spring for moving said leaf spring from its normal position to its engaged position whenever the trigger assembly is actuated.

* * * * *